US007311721B2

(12) United States Patent
Rosuck et al.

(10) Patent No.: US 7,311,721 B2
(45) Date of Patent: Dec. 25, 2007

(54) PACIFIER HAVING PIVOTALLY MOUNTED COVERS

(76) Inventors: Stefan E. Rosuck, 18073 W. Stockton Ct., Gurnee, IL (US) 60031; Marc D. Machtinger, 980 Thompson Blvd., Buffalo Grove, IL (US) 60089

( * ) Notice: Subject to any disclaimer, the term of this patent is extended or adjusted under 35 U.S.C. 154(b) by 314 days.

(21) Appl. No.: 10/822,632

(22) Filed: Apr. 12, 2004

(65) Prior Publication Data

US 2005/0065551 A1 Mar. 24, 2005

Related U.S. Application Data

(60) Provisional application No. 60/462,052, filed on Apr. 11, 2003.

(51) Int. Cl.

| | |
|---|---|
| ***A61J 17/00*** | (2006.01) |
| ***A61J 9/00*** | (2006.01) |
| ***A61J 9/08*** | (2006.01) |
| ***A61J 7/00*** | (2006.01) |
| ***B65D 39/00*** | (2006.01) |

(52) U.S. Cl. ..... 606/234; 215/11.6; 215/11.1; 215/235; 604/77; 604/78; 606/235; 606/236; D24/195; D24/196; D24/197

(58) Field of Classification Search ..... 606/234–236; D24/193–197, 45, 46, 199, 124; 215/11.1, 215/11.6, 235; 604/77, 78; D7/510, 511
See application file for complete search history.

(56) References Cited

U.S. PATENT DOCUMENTS

| | | | | |
|---|---|---|---|---|
| 2,860,639 | A | | 11/1958 | Hoover |
| 3,363,630 | A | | 1/1968 | Hines |
| 3,601,129 | A | * | 8/1971 | Seidl ..... 606/236 |
| D243,366 | S | | 2/1977 | Lybe et al. |
| 4,329,996 | A | | 5/1982 | Copeland |
| 4,417,613 | A | | 11/1983 | Ryan et al. |
| 4,493,324 | A | | 1/1985 | Johnston |
| 4,819,641 | A | | 4/1989 | Russell et al. |
| 4,946,054 | A | | 8/1990 | Maniero et al. |
| 5,156,617 | A | | 10/1992 | Reid |
| 5,211,656 | A | * | 5/1993 | Maddocks et al. ..... 606/236 |
| D340,287 | S | | 10/1993 | Hines |

(Continued)

*Primary Examiner*—(Jackie) Tan-Uyen Ho
*Assistant Examiner*—Melissa Ryckman
(74) *Attorney, Agent, or Firm*—Law Office of Marc D. Machtinger, Ltd.

(57) ABSTRACT

A pacifier assembly having a pivotally mounted cover on a shield assembly is disclosed. The assembly allows convenient protection for the nipple by being selectably moved between an open and closed position. In one embodiment, two nipples are provided on opposite sides of the shield assembly. The cover can be positioned to protect one nipple while exposing the other. Once the assembly is dropped to the floor and the sanitary condition of the exposed nipple is compromised, the cover can be moved to cover the dirtied nipple and expose the unused nipple. In another embodiment, the dual nipple pacifier includes two covers. Thus, the covers can protect both nipples simultaneously for transporting the assembly in a sanitary manner. One nipple can be exposed by pivoting one of the covers. Preferably, the covers nest within one another over the protected nipple. Once the sanitary condition of the exposed nipple has been compromised, both covers can be pivoted to cover the opposite nipple in a nested configuration to expose the unused nipple.

17 Claims, 7 Drawing Sheets

U.S. PATENT DOCUMENTS 5,273,172 A * 12/1993 Rossbach et al. ..... 215/229
5,366,481 A 11/1994 Zade
5,578,058 A * 11/1996 Chen ..... 606/236
5,843,128 A 12/1998 Wexler
D409,309 S 5/1999 Tollman
5,948,003 A 9/1999 Shefflin
5,964,784 A 10/1999 Wang
6,063,107 A 5/2000 Wexler
6,066,162 A 5/2000 Hudson
6,068,649 A 5/2000 Chamberlain
D430,300 S 8/2000 Anthony, Jr.
D448,486 S 9/2001 Horntrich
6,436,125 B1 * 8/2002 Rhoads ..... 606/234
6,461,374 B2 10/2002 Huang
6,485,505 B1 11/2002 Vasquez

* cited by examiner

PACIFIER HAVING PIVOTALLY MOUNTED COVERS

CROSS-REFERENCE TO RELATED APPLICATIONS

This application claims the benefit of U.S. Provisional Application No. 60/462,052, filed Apr. 11, 2003, which is hereby incorporated by reference herein in its entirety.

TECHNICAL FIELD

The present invention relates to a pacifier assembly, and more specifically to a pacifier assembly having an attached cover for covering the nipple of the pacifier, and to a pacifier assembly having dual nipples and nesting covers to protect the nipples.

BACKGROUND OF THE INVENTION

Conventional pacifiers are in common use for soothing infants and providing infants with a means to satisfy an innate non-nutritive sucking need. A conventional pacifier has a shield and a nipple extending from the shield. The nipple is typically formed of a resilient, flexible materia.

A common inconvenience associated with infant pacifier use is that pacifiers frequently fall out of or are ejected from infants' mouths. For example, if an infant falls asleep, ceases to suck on the pacifier, or moves its mouth in any number of ways, the pacifier is likely to fall from the infant's mouth. The pacifier will often drop to the floor or other unclean surface and the nipple will become dirty, especially when the pacifier falls to the ground in a public place.

When the nipple of the pacifier contacts surfaces which are not sanitary, the parent or caretaker of the infant must either clean the pacifier nipple, replace it with another pacifier, or allow the infant to use a pacifier, the sanitary condition of which has been compromised. As this sequence of events happens with great frequency, it is a great inconvenience to attend to the cleaning of pacifiers. This problem is intensified when the pacifier is being used in public areas where sanitary conditions of floors is poor, for example, in restaurants, restrooms, stores, etc., where numerous individuals walk with frequency. Since infants can be particularly susceptible to contracting illnesses, it is desirable to keep the nipple clean at all times. Therefore, when a pacifier is dropped, the typical parent or care provider must cease use of the pacifier until he or she can clean it. This is often not possible to attend to immediately. For example, when the pacifier is dropped in a public place, there may not be immediate access to a washroom. Furthermore, even simple transport of the pacifier, such as via a purse, pocket, or baby/child paraphernalia bag, or otherwise, can soil the nipple surface with dirt, dust, hair, germ or other undesirable particles.

This issue has been addressed in several manners. Several conventional pacifiers or pacifier covers are known and used which are designed to protect the nipple of a pacifier from soiling when not in use. There are numerous such devices which have a cap or cover piece which is separate from the pacifier. For example, U.S. Pat. No. 5,964,784, issued to Wang, discloses a pacifier with an attachable cap which is capable of releasably engaging the shield of the pacifier. U.S. Pat. No. 4,946,054, issued to Maniero et al. discloses a pacifier cover having a flange which is adapted to snap over the shield of the pacifier to hold the cover on the pacifier. U.S. Design Pat. No. Des. 409,309, issued to Tollman, discloses a pacifier having a single cover for the nipple. U.S. Pat. No. 4,493,324, issued to Johnston, discloses a pacifier cover which has a separate cover piece having two embossments which are adapted to fit into two corresponding apertures in the shield of the pacifier.

U.S. Pat. No. 4,417,613, issued to Ryan et al. discloses a universal pacifier case. The case has a housing which can fully enclose a typical nipple and shield assembly. The housing has a pair of engageable wall members hinged together for opening and closing the housing around the pacifier. U.S. Pat. No. 4,329,996, issued to Copeland discloses a protective pacifier having a cap which releasably attaches to the base of the pacifier by turning and snapping the cap on the base. When the pacifier is in use, the cap may be attached to the non-used side of the base.

Furthermore, U.S. Design Pat. No. Des. 243,366, issued to Lybe et al., discloses a protective casing for pacifiers. The casing has a plurality of horizontal rides adapted to engage a base or shield of a pacifier to hold the casing over the pacifier. U.S. Design Pat. No. Des. 448,486, issued to Horntrich, discloses a pacifier with a protective cover. The pacifier cover has two embossments which are adapted to fit within two apertures on the shield of the pacifier. U.S. Pat. No. 6,485,505, issued to Vasquez, discloses a pacifier cover wherein a pacifier may be extended through an opening in the cover and into the casing of the pacifier cover. A plurality of fingers extend from the opening and keep the pacifier in place. While these devices can protect the nipple from soiling when applied, oftentimes the pacifier cover is misplaced, lost, or left in a separate location while the pacifier is in use.

Other conventional pacifier designs attempted to address the problem of losing the separated cap or cover by providing an attached covering means for the nipple of the pacifier such that the cover would not be separated from the pacifier. For example, some conventional pacifiers have a cover which is attached to the pacifier shield or base via a ribbon to avoid separation of the components. For example, U.S. Design Pat. No. Des. 340,387 discloses an ornamental design for a combined pacifier and protector. The pacifier has a shield, a nipple, and a loop fixed to the shield. At the end of the loop, there is a cover adapted to fit over the nipple.

U.S. Pat. No. 5,156,617, issued to Reid, discloses a pacifier having a base with a hinged cover. A pacifier can be removably secured to the base. When the pacifier is in an infant's mouth, the cover may hang from the base by a ribbon. U.S. Pat. No. 5,948,003, discloses a pacifier clip cover for a single nipple with a clip to secure the cover to an infant's clothing while an infant sucks on a pacifier. There is a ribbon attached to a pacifier at one end. The other end of the ribbon is connected to a pinch cover for the pacifier. The pinch cover also has a clip such that the cover can be secured to an infant's clothing while the pacifier is in use. While these devices attempt to address the problem of misplacing the cap, the ribbon or string which attaches the cover to the pacifier is often troublesome. Infants often flail their arms and produce rapid jerking movements. Such movements are likely to either break the ribbon connection or displace the entire assembly from the infant's mouth. This can either cause an unwanted disturbance to the infant, or the entire device may fall to the floor or other unclean surface and become unclean notwithstanding the attached cover. If an infant crawls while a pacifier or cover is attached to the infant's clothing, the item may drag on the floor and become dirtied or get in the way. Furthermore, ribbons, strings, cords, chains, twine, leather straps, or yarn attachments can be dangerous to infants.

The covers in the above devices do not address the problem of the pacifier nipple becoming dirtied when it fall from an infant's mouth, since the cover is not generally protecting the nipple when the pacifier is most likely to fall.

Further such conventional pacifiers having an integral cover with the pacifier are known and used. For example, U.S. Pat. No. 4,819,641, issued to Russell et al., discloses a sanitary pacifier which has a concave base member supporting an upwardly extending nipple member. A concave top member is formed of a resilient material and defines a centrally elongated slot an a collapsible side wall extending downwardly to and secured to the base member. The base member and top member form an enclosure for the nipple member. A pair of handles extend through the base member and are secured to the top member on opposite sides of the elongated slot. The handle members may be drawn through the base member causing the top member to collapse and conform to the base member and causing the nipple member to extend through the elongated slot. Though this embodiment provides an integral means of covering the nipple, the device requires a number of different parts and is therefore expensive and difficult to manufacture.

Another conventional pacifier disclosed in U.S. Pat. No. 5,578,058, issued to Chen, discloses a single nipple pacifier with an integral cover. The pacifier has a base member and a nipple protrudes from a first side of the base member. A handle is secured to a second side of the base member. There is a pair of half shells which can open to form the conventional shield such that the infant does not swallow the pacifier. The half shells are pivotally connected to the base member such that they can be drawn to a closed position around the nipple. Though the device uses the same components as part of the shield and cover, the device is not a useful solution because the half shells of the device are uncomfortably too large. The half shells are required to be a large size to cover the nipple when the two half shells are brought together. Therefore, when the half shells are unfolded to form the shield, they are uncomfortably large for most infant's faces. Furthermore, they will not likely close when the pacifier is dropped.

Other conventional pacifiers having an integral means of covering the nipple are known and used. For example, U.S. Pat. No. 6,066,162, issued to Hudson, discloses a pacifier having a retractable nipple wherein the nipple is retractable into the pacifier body when the pacifier is not in use. The pacifier body has a bottom body opening and a flexible nipple structure attached to the top portion of the nipple body. There is a retraction mechanism which is mechanically connected to a nipple tip portion of the nipple structure for mechanically inverting the nipple tip portion and pulling it within a compartment formed within the pacifier. U.S. Pat. No. 5,366,481, issued to Zade, also discloses a retractable pacifier. The nipple and shield assembly of the pacifier are moved upward within has a cylindrical housing and may be locked into place via a tab. While these devices provide an integral means of keeping the nipple clean when not in use, the method is not very effective. When the pacifier is used, saliva and other germs collect on the nipple. When the nipple is retracted into the housing, the saliva and germs are transferred directly onto the housing. Even after one or two uses, the whole assembly should be cleaned to avoid placing an unclean nipple back in the infant's mouth.

Other conventional pacifiers having an integral means of covering the nipple have been contemplated. Some such devices have a collapsible portion on the pacifier. U.S. Pat. No. 3,363,630, issued to Hines, discloses a pacifier with a collapsible shield. The pacifier has a face plate, an aperture in the face plate, a nipple, and a collapsible shield preferably made of rubber. When the infant sucks on the nipple, the shield is pressed backward and the nipple protrudes through the aperture in the face plate. When the infant is done with sucking on the nipple and pressure is released on the face plate, the shield springs back to its normal position and covers the nipple. Also, U.S. Pat. No. 6,461,374, issued to Huang, discloses a protective pacifier nipple. A protective sleeve consisting of a serpentine tubular structure covers the nipple when the nipple is not in use. When the nipple is in use, the serpentine tubular structure is collapsed and the nipple is exposed. These devices are not very useful because they rely on steady suction from the infant's mouth to keep the nipple exposed. A problem with such devices is that infants do not and are oftentimes incapable of applying steady suction to the pacifier. Even when an infant stops sucking to take a short breath or simply stops sucking for a short time, the collapsible portions can snap back to their normal position and increase the tendency for the pacifier to slip out of the infant's mouth.

There are further conventional baby pacifiers having an internal means of preventing the soiling of the nipple. For example, U.S. Pat. No. 6,068,649, issued to Chamberlain, discloses a pacifier which is secured inside an infant's mouth by adjustable straps. The pacifier solves the problem of losing the pacifier when on the infant's mouth, but this configuration is often uncomfortable to an infant who often needs to make sounds, cough, or exhale. The device also does not protect the nipple unless it is worn by the baby. Furthermore, the device is uncomfortable for an infant who often wishes to take a break from the pacifier.

Since it is not uncommon for a baby to drop a pacifier regardless of whether the pacifier has no cover, a separate cover, or an attached cover, pacifiers having multiple nipples are known and used. For example, U.S. Pat. No. 6,436,125, issued to Rhoads, discloses a double-sided baby pacifier. The pacifier has two nipple portions integrally connected to a middle support member. The support member may move from a neutral position and become either convex or concave depending upon which side of the pacifier is being sucked on. U.S. Pat. Design No. 430,300, also discloses an ornamental design of a dual nipple pacifier.

U.S. Pat. No. 6,063,107, issued to Wexler, discloses a baby toy having up to six nipples on its periphery surfaces. The nipples are inserted into holes on the periphery surface and are held in place by retainers. The toy can be transformed into a plural nipple ball with a handle by substituting a handle assembly for one of the nipples. U.S. Pat. No. 5,843,128, discloses a one piece pliable molded polymer pacifier having a pair of hollow balls. Each ball has a plurality of nipples disposed on its surface and 90 degrees apart from one another. These devices provide an additional nipple so that if one is soiled, the other nipple(s) may be used. These devices are deficient however because they do not provide for any covering of any of the nipples. Since babies frequently will drop the above devices, it is very likely all the nipples will become soiled at the same time when dropped.

U.S. Pat. No. 5,211,656, discloses a dual nipple pacifier having a shield, a cover, and a pair of nipples projecting from opposite sides of the shield. There is a releasable cover which can be placed on one of the nipples while the other is exposed. One drawback of this device is the cover is a separate piece which can be misplaced as discussed above. Another drawback is one nipple is still exposed and when a parent is carrying the nipple, the exposed nipple may still be contaminated with hair, dirt, or other contaminants.

Thus, it would be desirable to provide a double nipple pacifier with one easily movable, integral cover and also a double nipple pacifier having an easily movable, integral cover for each nipple of the pacifier.

It would be further desirable to provide a single nipple pacifier having a pacifier shield which is easily movable and engagable over the nipple having fewer parts and greater durabiltity.

SUMMARY

In view of the insufficiencies discussed above, it is an object of the present invention to provide a pacifier assembly having a cover movably mounted to the shield. It is a further object of the invention to provide a pacifier assembly which can protect the nipple of the pacifier and which decreases the inconveniences derived from the pacifier falling on the floor.

In accordance with the above objectives, a pacifier assembly having a cover movably mounted to the pacifier assembly is disclosed. The cover is mounted such that it is manually movable, and preferably pivotally movable, between an open position and a closed position. In the closed position, the cover protects and covers the nipple. In the open position, the cover exposes the nipple. Preferably, when in the open position, the cover forms a knob or handle on the outer side of the shield.

In a preferred embodiment, the assembly includes a mechanism for holding the cover in place in the open position, closed position, or both. The mechanism is optionally snap fit elements on the cover or shield or both.

In another embodiment, the pacifier shield includes a shield assembly having two nipples. One nipple extends from one side of the shield, the other from the opposite side. At least one cover is pivotally mounted in a central portion of the shield assembly such that the cover can be positioned to cover one or the other of the two nipples.

In a further embodiment, a second cover is pivotally mounted to the pacifier assembly in such a manner that the covers can protect each of the nipples, respectively, simultaneously. This allows the pacifier assembly to be carried without exposing either of the nipples to unsanitary elements. In order to prepare the pacifier for use, one of the two covers is pivoted to the opposite position into a configuration in which the moved cover either collapses, is moved out of the way, or nests with the other cover. If the pacifier is dropped, both covers can be moved to the other side to cover the dirtied nipple and to expose the unused nipple. Thus, at least one step of cleaning the pacifier can be eliminated since cleaning of the pacifier can be delayed until both nipples have been dropped to the floor when in an exposed configuration.

In yet a further preferred embodiment, the pacifier assembly includes a shield assembly having two shield members. The shield members are permanently mounted back to back to one another. One manner in which the shields may be mounted to one another is via a raised interface wall on the inside surfaces of each shield member. The interface walls substantially surround the hole through which the nipples pass. The shield members are fused, adhered, or otherwise permanently mounted to one another. Optionally, the walls include grooves through which pivot pins from the covers are mounted.

The two nipples of the pacifier assembly are optionally formed as a single integral nipple unit. The nipple unit has a flanged portion at its center such that it can be mounted within a shield assembly in such a way that it cannot be pulled through the apertures in the shield assembly.

In another embodiment, the nipples are provided as separate conventional nipple units. In this embodiment, the nipples each comprise flanged portions which are mounted on the inner side of the shield assembly to prevent the nipples from being pulled through the aperture in the shield.

The covers of the pacifier assembly are preferably shaped and sized in such a way that bulkiness is minimized. In order for the covers to be pivoted to opposite sides of the pacifier assembly, slots are provided in the shield assembly. The inner cavities of the covers house the nipples. In order that the size of the covers need not be so great, they may be sized such that the nipples must be bent or contorted in order that they will fit within the covers. Conventional nipples generally spring back to and retain their original shape even after being bent for a prolonged period of time.

The pacifier assembly as disclosed has the advantages that it may be carried without exposing the nipples, and it reduces the frequency with which one must attend to cleaning the pacifier if the pacifier should fall to the ground, since at least one of the two nipples is always protected. The number of pacifiers a parent needs to carry along with an infant can also thus be reduced. This can become particularly important when an infant is taken to a public place such as a store or restaurant where floor conditions can be particularly unsanitary.

Other features and advantages of the invention will be apparent from the following detailed description taken in conjunction with the following drawings.

DETAILED DESCRIPTION

Figure 1:
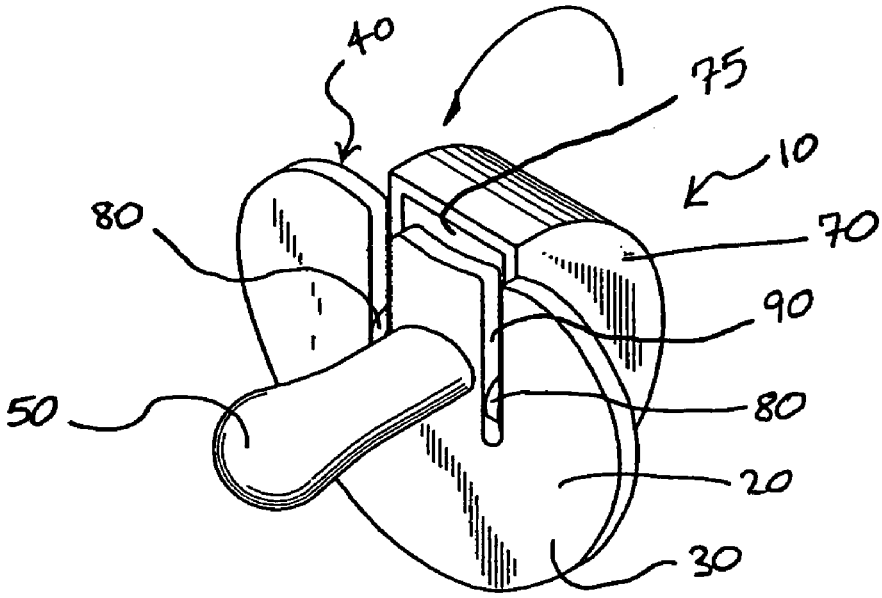
FIG. 1 is a perspective view of a preferred embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A pacifier assembly 10 is disclosed. The assembly 10 includes a shield 20 having a first side 30 and a second side 40. A nipple 50 extends outward from the first side 30 of the shield 20 from an aperture 60 in the shield 20.

A nipple cover 70 is permanently movably mounted to the shield 20 and selectably movable between an open position exposing the nipple 50, as shown in FIG. 1, and a closed position covering the nipple 50. The cover 70 has an interior cavity 75 adapted to encompass the nipple 50. The cavity 75 can be sized and shaped to receive the nipple 50 without deforming it. Alternatively, in order to keep the size and shape of the cover 70 as unobtrusive as practical, the nipple 50 may need to be bent or contorted in order to fit within the cavity 75. For example, the user might bend the nipple 50 manually as the cover 70 is positioned over it. Alternatively, the cover 70 might be configured such that it automatically bends the nipple 50 as needed as it is closed. These options are equally applicable to the dual nipple and dual cover embodiments described below.

The cover 70 can serve as a knob or handle when in the open position, and is preferably pivotally mounted to the shield 20.

Preferably, the cover 70 is pivotally mounted at pivot points in a central area 80 of the shield 20. In order to free the cover 70 to pivot as described, slots 90 are optionally provided in shield 20 to allow walls of the cover 70 to pass through the shield 20. Slots 90 ideally have rounded corners to create a smooth surface.

In another preferred embodiment, the pacifier assembly includes a shield 100 having a first side 110 and a second side 120. A first nipple 130 extends outward from the first side 110 of the shield 100 from a first aperture 140 in the shield 100. In addition, a second nipple 150 extends outward from the second side 120 of the shield 100 from a second aperture 170 in the shield 100. Shield 100 is optionally flexible such that it can be formed to be concave on either side corresponding to the nipple being used at the time. Alternatively, it can be rigid and shaped to be concave on both sides.

Figure 2:
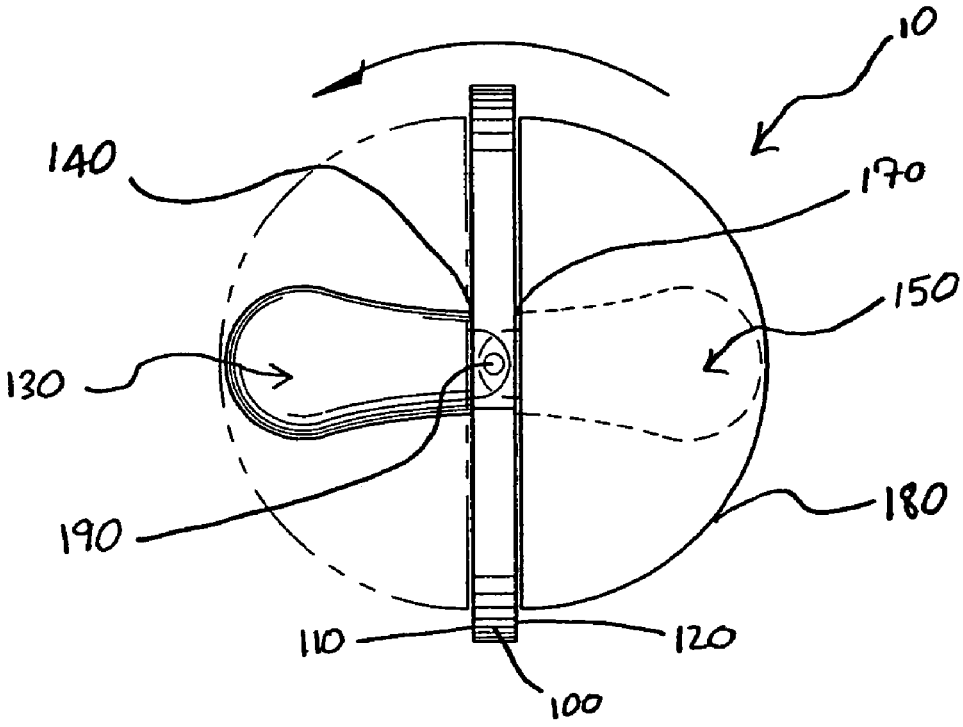
FIG. 2 is a side view of another preferred embodiment of the present invention showing two possible positions of the cover.
Figure 3:
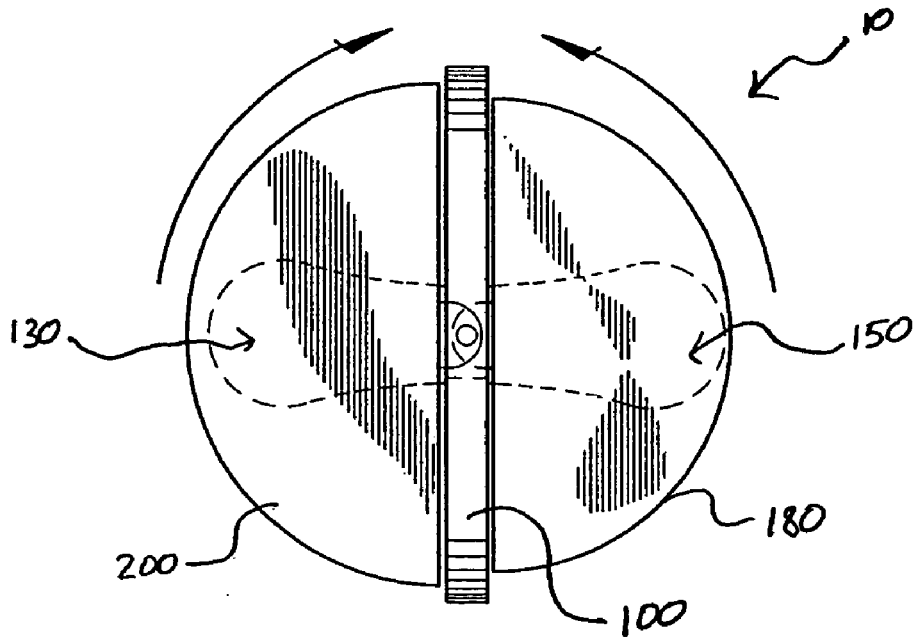
FIG. 3 is a side view of yet another preferred embodiment of the present invention showing possible pivoting motion of the covers.
Figure 4:
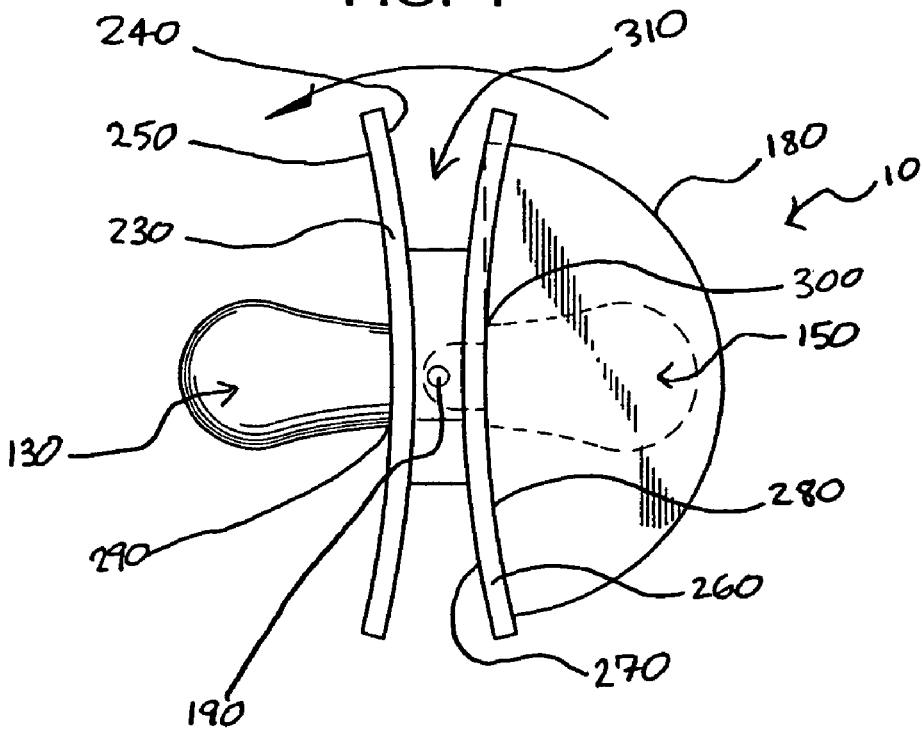
FIG. 4 is a side view of a further preferred embodiment of the present invention.
Figure 5:
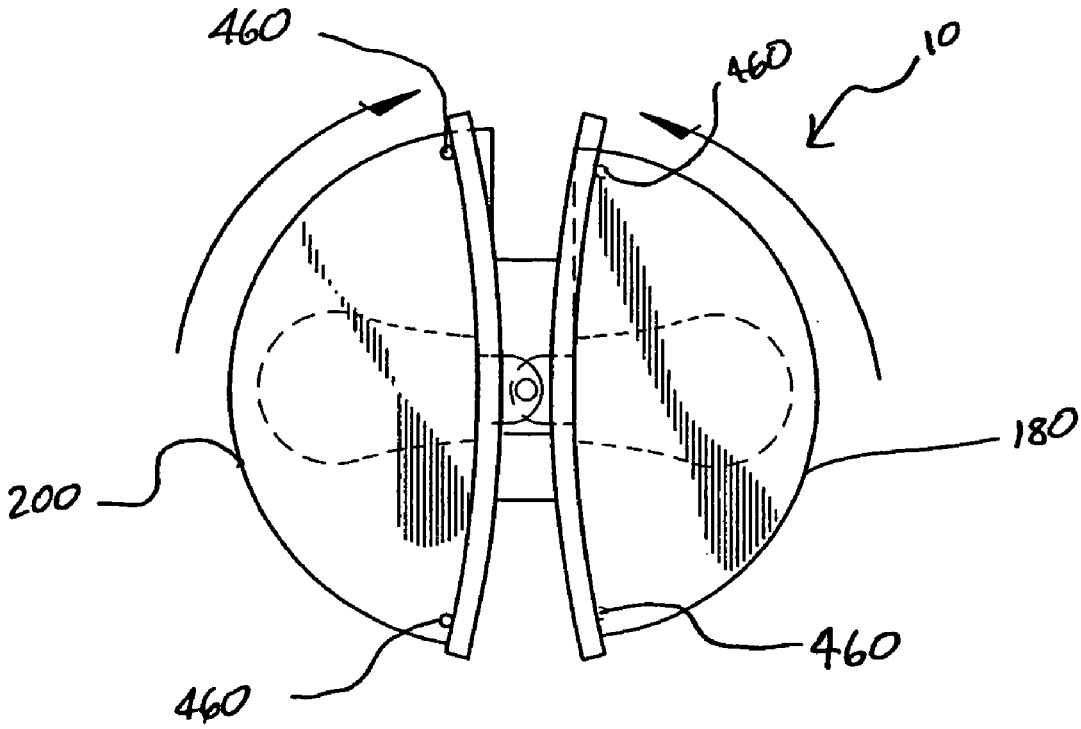
FIG. 5 is a side view of yet a further preferred embodiment of the present invention.
Figure 6:
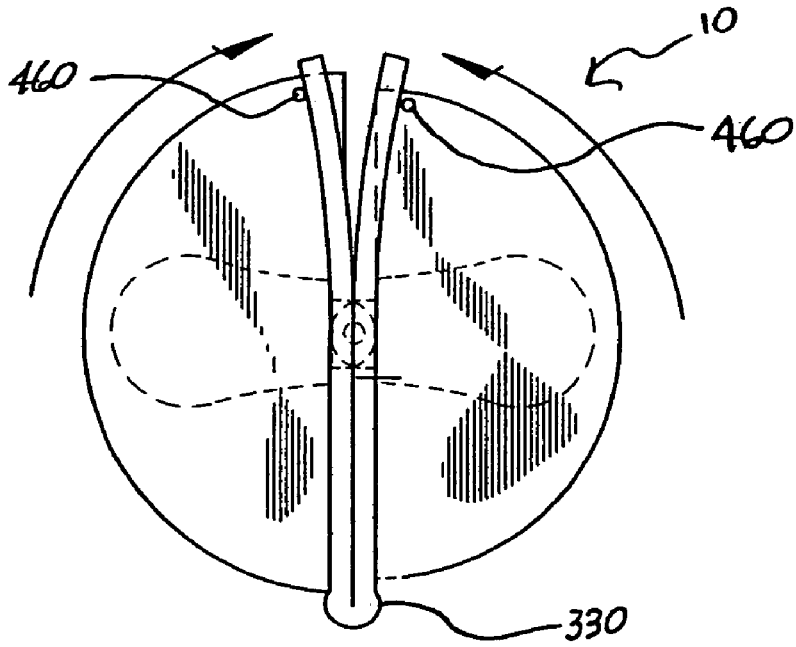
FIG. 6 is a side view of still a further preferred embodiment of the present invention.
Figure 7A:
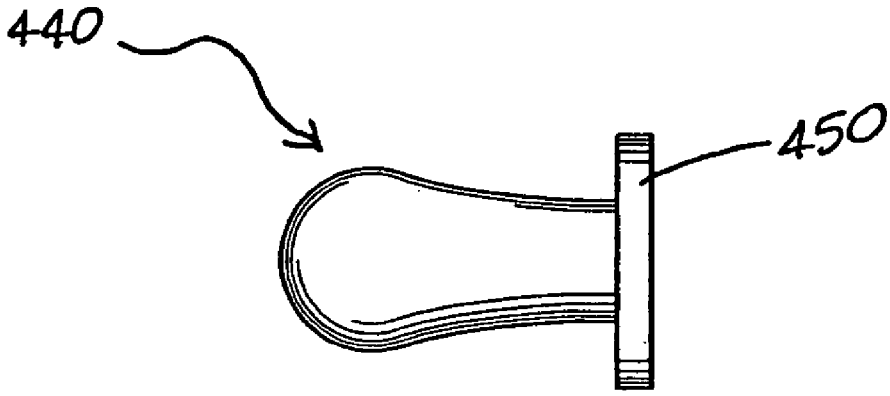
FIG. 7A is a side view of a nipple of the present invention.
Figure 7B:
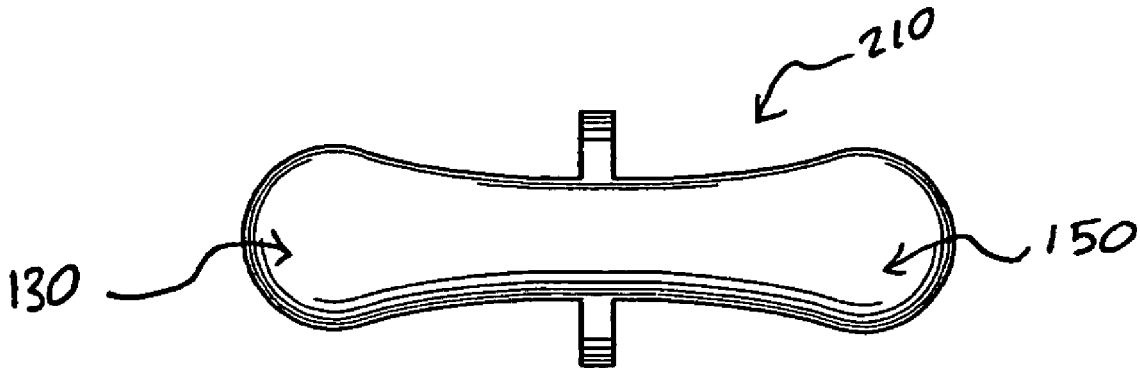
FIG. 7B is a side view of an integral dual nipple unit of one embodiment of the present invention.
Figure 8:
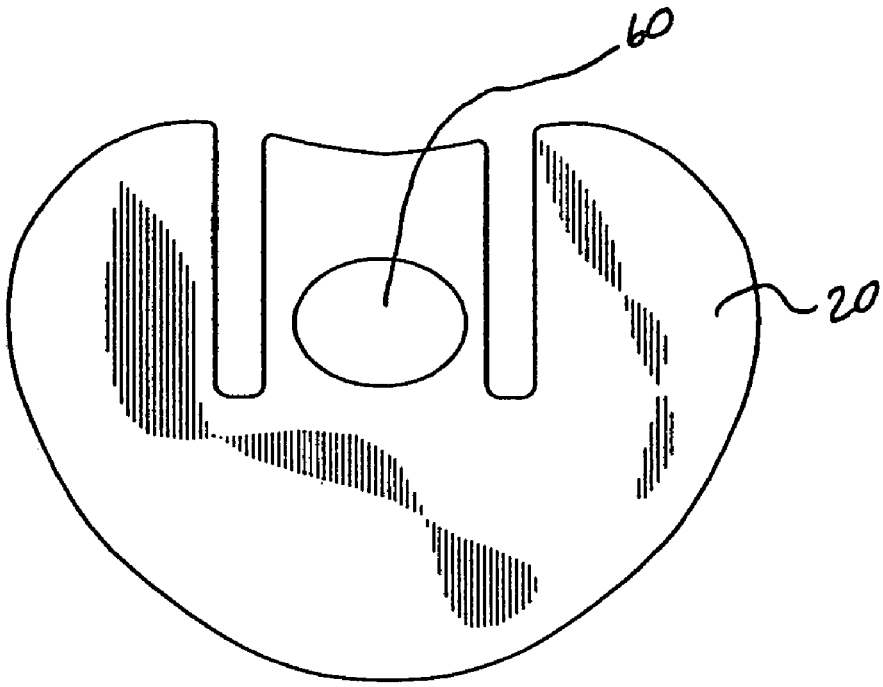
FIG. 8 is a front view of a shield having slots in one embodiment of the present invention.
Figure 9:
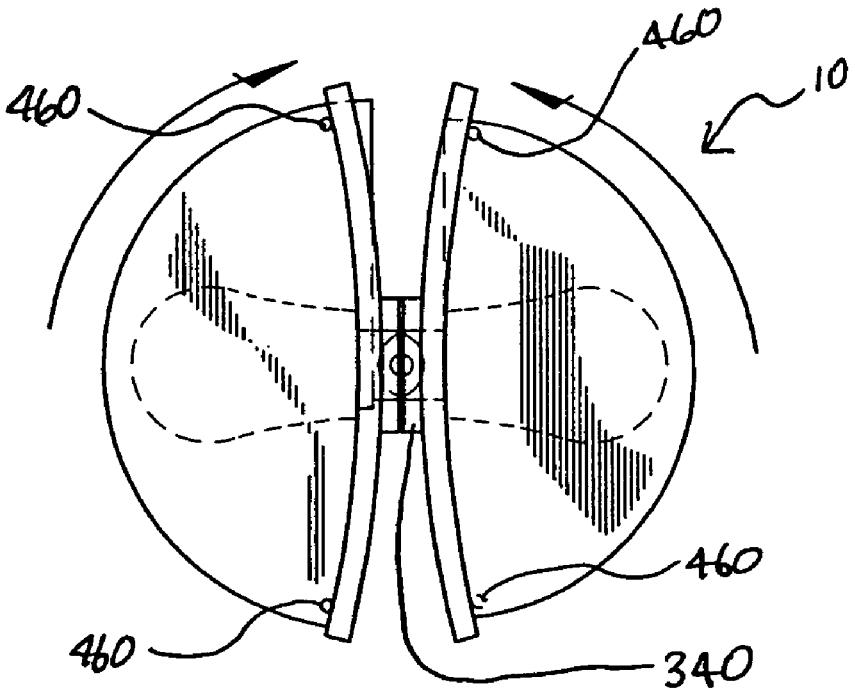
FIG. 9 is a side view of another preferred embodiment of the present invention.

A first cover 180 is permanently movably mounted to the shield 100. The first cover 180 is selectably movable between a first position in which the first nipple 130 is covered and a second position in which the first nipple 130 is left uncovered by the first cover 180, as illustrated in FIG. 2.

Preferably, the first cover 180 is pivotally mounted at central pivot points 190 on the shield 100 located in a central area of the shield. The first cover 180 pivots through at least one slot in the shield 100. Ideally, the second nipple 150 is covered by the first cover 180 when the first cover 180 is in the second position, as illustrated in FIG. 2.

In a further preferred embodiment, the pacifier assembly further includes a second cover 200 pivotally mounted to the shield 100. The second cover 200 is selectably movably between a first position in which the second nipple 150 is covered and a second position in which the second nipple 150 is left uncovered by the second cover 200.

Thus, several conditions are possible. In one configuration, the first nipple 130 is covered by the first cover 180 and the second nipple 150 is covered by the second cover 200 under the condition that the first cover 180 is in its first position and the second cover 200 is in its first position.

In another configuration, the first nipple 130 is covered by the second cover 200 and the second nipple 150 is covered by the first cover 180 under the condition that the first cover 180 is in its second position and the second cover 200 is in its second position.

In yet another configuration, when the first cover 180 is in its first position and the second cover 200 is in its second position, the first nipple 130 is covered by both the first cover 180 and the second cover 200 in a nested configuration, and the second nipple 150 is exposed. In order to nest, the covers 180 and 200 must be shaped and sized in a manner in which one is adapted to receive the other.

In a further configuration, when the first cover 180 is in its second position and the second cover 200 is in its first position, the second nipple 150 is covered by both the first cover 180 and the second cover 200 in a nested configuration, and the first nipple 130 is exposed.

Thus, given the selectable configurations described above, the pacifier assembly 10 can be transported in a sanitary fashion with both nipples 130 and 150 protected, one nipple 130 can be exposed for use by an infant, and the other nipple 150 can be exposed once the sanitary condition of the first nipple 130 has been compromised. In the embodiments including two covers, the covers are optionally differentiated by color, indicia, or configuration aspects so that the user can determine which nipple has already been dirtied, or what the status of the pacifier is. In the single cover embodiments, color, indicia, or configuration aspects can be used to determine what the status of the pacifier is by covering one of the nipples first, then the second after it has been dirtied.

In each of the embodiments described herein, the covers 180 and 200 can be composed of any suitable material. Such material can be rigid such that the covers 180 and 200 hold their shape. Alternatively, the covers may be of a flexible material such as an elastomeric material. In order to meet certain regulations and standards for pacifiers, parts of the pacifier may not be permitted to protrude beyond a certain distance, such as 0.63 inches, from the face of the shield on the side opposite the nipple. In order to test for this requirement, an object with a flat surface can be placed over such parts, and force up to two pounds is applied downward in the direction of the length of the nipple. Thus, the parts can be compressed to comply with such specifications. A flexible material cover might be able to comply with such specifications without the need for its unstressed dimensions conforming to these specifications. The nipple beneath the cover could be compressed along with the cover. The covers 180 and 200 can be configured to nest one within the other, or could be collapsible such that one is out of the way when in an open position, or can simply move to a position which is out of the way of the normal operation of the pacifier.

In each of the embodiment described herein, the pacifier assembly 10 preferably comprises a first mechanism for temporarily securing the at least one of the covers 70, 180, etc., such as first cover 180 in either its first or second position. In the embodiments with two covers, a second mechanism is provided for temporarily securing the second cover 200 in either its first or second position. The mechanisms may be snap fit members on the covers, shield, or both which are adapted to releasably secure the covers in their respective positions so that they are not easily inadvertently moved out of position. Any other suitable mechanism for releasably securing the covers into positions is contemplated to be within the scope of the present invention.

The first nipple 130 and second nipple 150 are optionally parts of an integral dual nipple unit 210 which is mounted within the shield 100 at a central portion. A flange 220 is mounted within the shield in order to prevent the unit 210 from being pulled out of either aperture 140 or 170.

Alternatively, the first and second nipples 130 and 150 are separate nipple units 440 each having a flanged distal end 450 mounted on an inside shoulder portion 175 of the apertures 140 and 170. Shoulder portion 175 may be the surrounding area around the apertures 140 and 170. Apertures 140 and 170 may be distinct and out of line, or may opposite ends of one continuous bore through the shield 100. A separate retaining unit is optionally inserted into the distal ends of the nipples 440, and has a shoulder which assists in retaining the nipple 440 and keeping it from being pulled through the apertures 290 or 300. A retaining member which is a single piece unit and has a single central shoulder can be used to fit into both nipple units 440.

The outer sides of the shield 20 or 100 of any of the embodiments described herein ideally are shaped to comfortably conform to the contours of the face of an infant. This will most likely involve a concave shape. Additional holes in the shields 20 or 100 can be provided. Alternatively, the slots 90 can serve any safety functions of such holes.

In yet a further preferred embodiment of the present invention, the pacifier shield assembly 310 has a first shield member 230 comprising an inner side 240 and an outer side 250, and a second shield member 260 comprising an inner side 270 and an outer side 280. The first and second shield members 230 and 260 are permanently attached to one another at their respective inner sides 240 and 270.

A first nipple 130 extends outward from the outer side 250 of the first shield member 230 from a first aperture 290 in the first shield member 230, and a second nipple 150 extends outward from the outer side 280 of the second shield member 260 from a second aperture 300 in the second shield member 260.

A first cover 180 is pivotally mounted to the shield assembly 310 and selectably movable between a first position in which the first nipple 130 is covered by the first cover 180, and a second position in which the second nipple 150 is covered by the first cover 180.

As with the previous embodiments, the first cover 180 is pivotally mounted at central pivot points 190 on the shield assembly 310 located in a central area of the shield assembly 310, and the first cover 180 pivots through slots 320 in the shield assembly 310. Slots 320 preferably have rounded corners and edges to create a smooth surface.

In a preferred form of this embodiment, the pacifier assembly 10 further comprises a second cover 200 pivotally mounted to the shield assembly 310 and selectably movably between a first position in which the second nipple 150 is covered by the second cover 200 and a second position in which the first nipple 130 is covered by the second cover 200.

The configurations described above for the previous embodiments are equally applicable to this embodiment. Ideally, the pacifier assembly 10 can be selectably manually placed in at least three configurations, wherein under the condition that the assembly 10 is in a first configuration, the first nipple 130 is covered by the first cover 180 and the second nipple 150 is covered by the second cover 200. Under the condition that the assembly 10 is in a second configuration, the first nipple 130 is covered by both the first cover 180 and the second cover 200 in a nested configuration, and the second nipple 150 is exposed. Under the condition that the assembly 10 is in a third configuration, the second nipple 150 is covered by both the second cover 200 and the first cover 180 in a nested configuration, and the first nipple 130 is exposed.

In this embodiment, a first mechanism for temporarily securing the first cover 180 in either its first or second position, and a second mechanism for temporarily securing the second cover 200 in either its first or second position is provided. These may be releasable snap fit members which may be on the covers 180 and 200, the shield assembly 310, or both. For example, retaining protrusions 460 or the like could be used to snap past slots 320 to secure the covers 180 and 200 into place.

The first nipple 130 comprises a flanged distal end mounted on a first inside shoulder portion 175 of the first aperture 290, and the second nipple 150 comprises a flanged distal end mounted on a second inside shoulder portion 175 of the second aperture 300. The outer sides 250 and 280 of the shield members 230 and 260 are each shaped concavely to follow the contour of the face of an infant. They may be formed integrally or be spaced closely together at a bottom portion 330, and may diverge as they are contoured upward.

The shield members 230 and 260 can be attached to one another by any suitable means. In one embodiment, raised interface walls 340 extend from the inner sides 240 and 270 of the shield members 230 and 260 and substantially surround perimeters of the apertures 290 and 300. The interface walls 340 preferably have grooves 350 for receiving a pivot pin 360 extending from the covers 180 and 200. The shield members 230 and 260 are mounted at opposing interface walls 340 via fusing, sonic welding, adhesive application, or any other suitable means.

Figure 10:
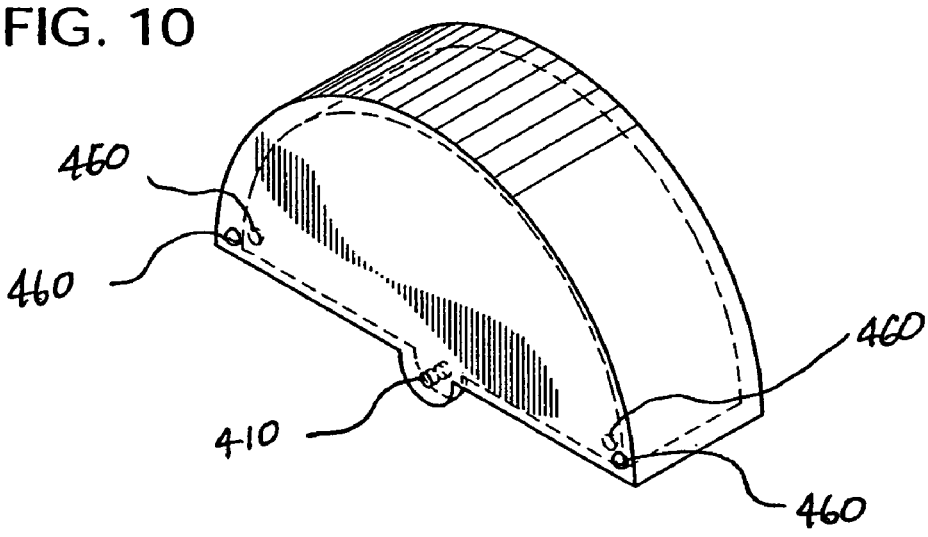
FIG. 10 is a perspective view of nested covers of a preferred embodiment of the present invention.
Figure 11:
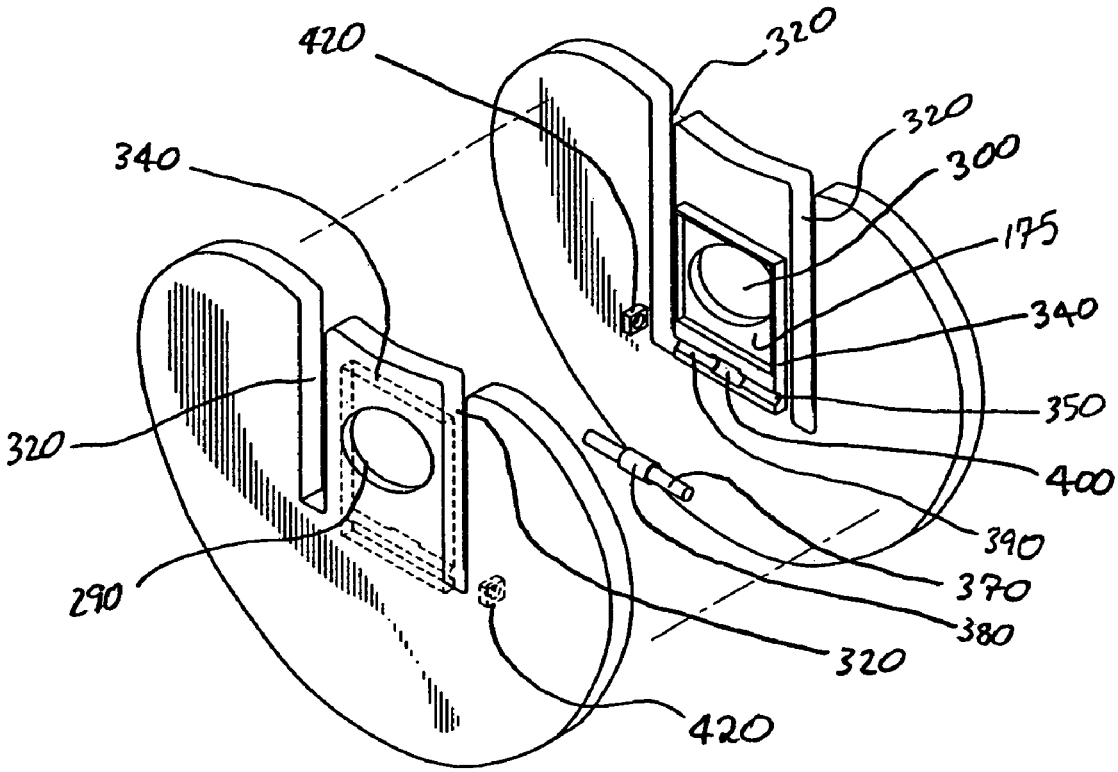
FIG. 11 is an exploded view of a shield assembly of one embodiment of the present invention.
Figure 12:
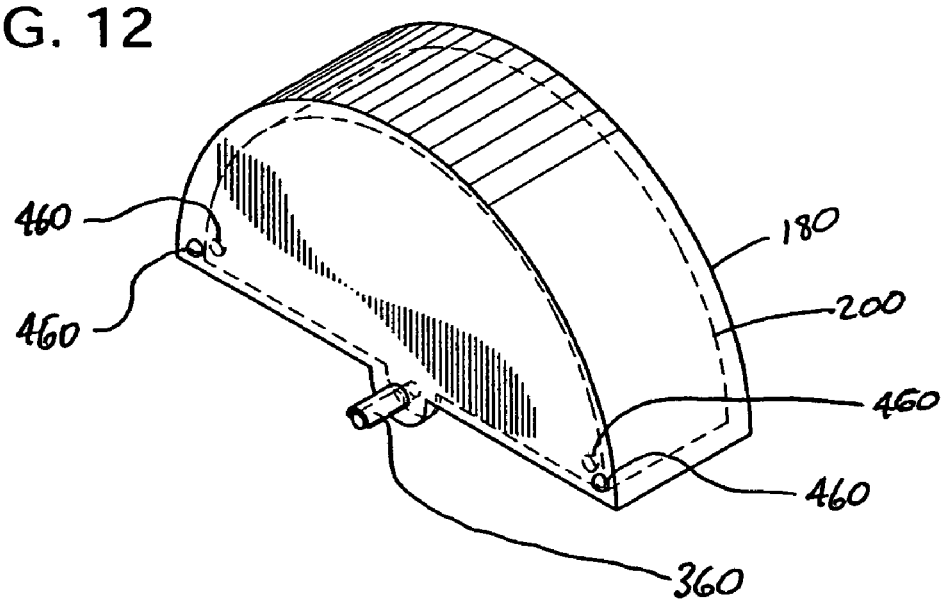
FIG. 12 is perspective view of nested covers of another preferred embodiment of the present invention.

The covers 180 and 200 preferably are adapted to be nested as illustrated in FIGS. 10 and 12. The method of mounting the covers 180 and 200 to the shield assembly 310 can be any suitable method. In one embodiment, the covers 180 and 200 are pivotally mounted via one or more pins 360 and holes. The pin or pins 360 can be on the shield assembly 310 itself, or can be a separate pin member 370 which is held into place within the interface walls 340, as illustrated in FIG. 11. In the embodiment illustrated in FIG. 11, the pin 370 optionally includes a retainer component 380 and can be fitted into a cutout 390 having a retaining groove 400. The pin 370 can be placed through holes 410 on the covers 180 and 200. In this configuration, pin 370 can be held in place by retainers 420, such as those shown in FIG. 11.

Figure 13:
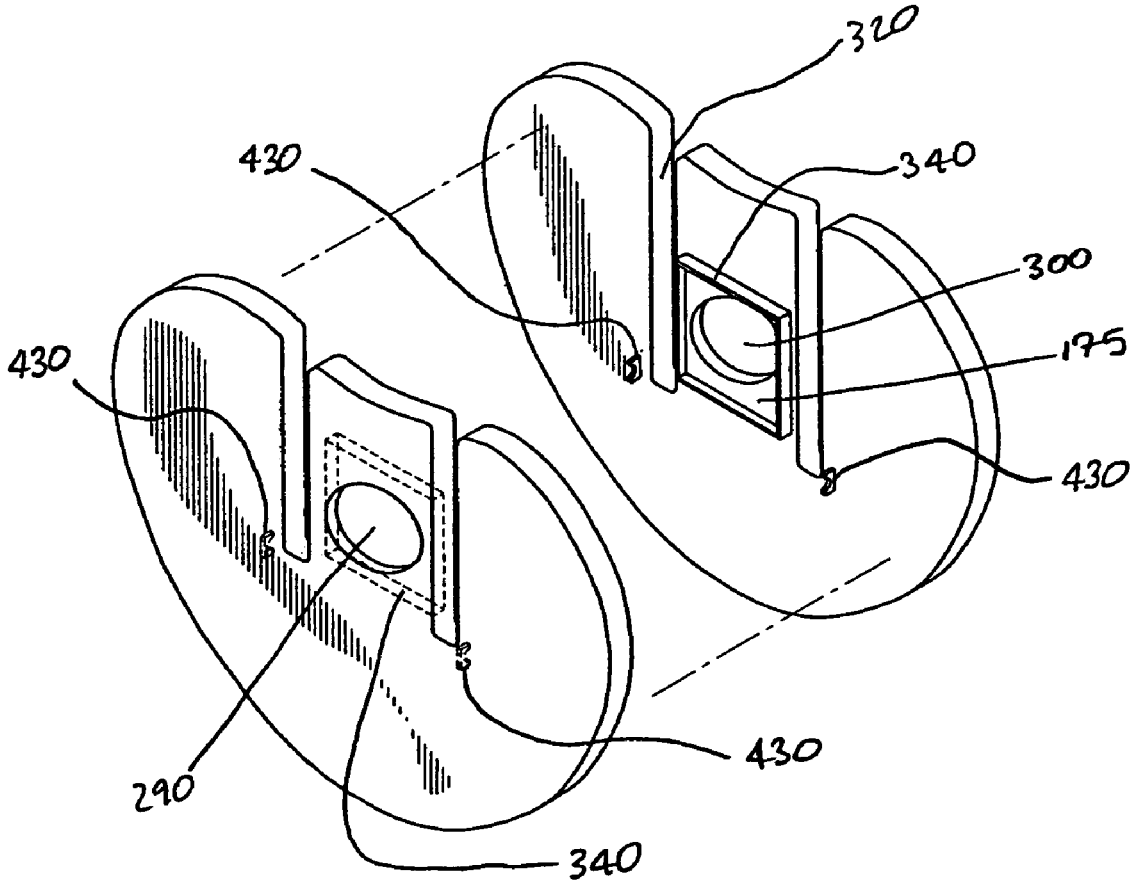
FIG. 13 is an exploded view of a shield assembly of another embodiment of the present invention.

In another embodiment, as illustrated in FIGS. 12 and 13, pins 360 can be nested pins 360 extending from the covers 180 and 200, and can be held into place by pin retainers 430. Pins 360 may extend inward or outward from the cover walls of the covers 180 and 200. The pins 360 may be nested within one another in the embodiment in which they extend from the walls of the covers 180 and 200, and may be received within grooves 390 or 430.

Any other suitable mechanism for pivotally mounting the covers 180 and 200 to the device 10 is also contemplated within the scope of the present invention.

In an alternate embodiment, one or two flexible covers are pivotally or hingedly mounted to the shield at a top, bottom, or side, or other portion of the shield close to the perimeter of the shield. In this embodiment, the covers can be flipped over the nipple, and can be inverted inside-out when flipped over to the other side. These covers can be mounted at the same points, or can be separately mounted at different places along the shield.

A method for manufacturing the pacifier assembly of the present invention is additionally intended within the scope of the invention, as detailed herein. The method includes the steps of providing and assembling the parts described herein.

While the specific embodiments have been illustrated and described, numerous modifications come to mind without significantly departing from the spirit of the invention, and the scope of protection is only limited by the scope of the accompanying claims.

What is claimed is:

1. A pacifier assembly comprising:

a shield having a first side and a second side, a nipple extending outward from the first side of said shield from an aperture in said shield, and a nipple cover permanently movably mounted to said shield and selectably movable via a single action motion between an open position exposing said nipple and a closed position covering said nipple, wherein said nipple cover comprises an interior cavity, and wherein, in said closed position, said interior cavity substantially, entirely envelopes said nipple, and wherein, in said open position, said interior cavity remains intact and, wherein said nipple cover substantially rotates from the first side of said shield to the second side of said shield.

2. The pacifier assembly according to claim 1, wherein said cover is pivotally mounted to said shield.

3. The pacifier assembly according to claim 2, wherein said cover is pivotally mounted at central pivot points on said shield located in a central area of said shield, and wherein said cover pivots through slots in said shield.

4. A pacifier assembly comprising:

a shield having a first side and a second side, a first nipple extending outward from the first side of said shield from a first aperture in said shield, and a second nipple extending outward from the second side of said shield from a second aperture in said shield, and a first cover permanently movably mounted to said shield and selectably movable via a single action motion between a first position in which said first nipple is covered and a second position in which said first nipple is left uncovered by said first cover, wherein said cover comprises an interior cavity, and wherein, in said first position, said interior cavity substantially, entirely envelopes said nipple, and wherein, in said second position, said interior cavity remains intact and, wherein said nipple cover substantially rotates from the first side of said shield to the second side of said shield.

5. The pacifier assembly according to claim 4, wherein said first cover is pivotally mounted at central pivot points on said shield located in a central area of said shield, and wherein said first cover pivots through at least one slot in said shield.

6. The pacifier assembly according to claim 5, wherein said second nipple is covered by said first cover when said first cover is in the second position.

7. A pacifier assembly comprising:

a shield having a first side and a second side, a first nipple extending outward from the first side of said shield from a first aperture in said shield, and a second nipple extending outward from the second side of said shield from a second aperture in said shield, and a first cover permanently movably mounted to said shield and selectably movable between a first position in which said first nipple is covered and a second position in which said first nipple is left uncovered by said first cover, and further comprising a second cover pivotally mounted to said shield and selectably movably between a first position in which said second nipple is covered and a second position in which said second nipple is left uncovered by said second cover.

8. The pacifier assembly according to claim 7, wherein said first nipple is covered by said first cover and said second nipple is covered by said second cover under the condition that said first cover is in its first position and said second cover is in its first position.

9. The pacifier assembly according to claim 7, wherein said first nipple is covered by said second cover and said second nipple is covered by said first cover under the condition that said first cover is in its second position and said second cover is in its second position.

10. The pacifier assembly according to claim 7, wherein, under the condition that said first cover is in its first position and said second cover is in its second position, said first nipple is covered by both said first cover and said second cover in a nested configuration, and said second nipple is exposed.

11. The pacifier assembly according to claim 7, wherein, under the condition that said first cover is in its second position and said second cover is in its first position, said second nipple is covered by both said first cover and said second cover in a nested configuration, and said first nipple is exposed.

12. The pacifier assembly according to claim 7, wherein said assembly can be selectably manually placed in at least three configurations, wherein:

under the condition that said assembly is in a first configuration, said first nipple is covered by said first cover and said second nipple is covered by said second cover, under the condition that said assembly is in a second configuration, said first nipple is covered by both said first cover and said second cover in a nested configuration, and said second nipple is exposed, and under the condition that said assembly is in a third configuration, said second nipple is covered by both said second cover and said first cover in a nested configuration, and said first nipple is exposed.

13. The pacifier assembly according to claim 7, further comprising a first mechanism for temporarily securing said first cover in either its first or second position, and a second mechanism for temporarily securing said second cover in either its first or second position.

14. The pacifier assembly according to claim 13, wherein said first mechanism and said second mechanism comprise snap fit members which releasably secure said covers in their respective positions.

15. The pacifier assembly according to claim 7, wherein said first nipple and said second nipple are parts of an integral dual nipple unit which is mounted within said shield at a central portion.

16. The pacifier assembly according to claim 7, wherein said first nipple comprises a flanged distal end mounted on a first inside shoulder portion of said first aperture, and said second nipple comprises a flanged distal end mounted on a second inside shoulder portion of said second aperture.

17. The pacifier assembly according to claim 16, wherein said first aperture and said second aperture form opposite sides of a continuous bore through said shield.

* * * * *